US008677663B1

(12) United States Patent
Tyszko

(10) Patent No.: US 8,677,663 B1
(45) Date of Patent: Mar. 25, 2014

(54) SIGN DISPLAY

(76) Inventor: Jeffery D. Tyszko, Port Richey, FL (US)

( * ) Notice: Subject to any disclaimer, the term of this patent is extended or adjusted under 35 U.S.C. 154(b) by 0 days.

(21) Appl. No.: 13/611,695

(22) Filed: Sep. 12, 2012

Related U.S. Application Data

(60) Provisional application No. 61/533,870, filed on Sep. 13, 2011.

(51) Int. Cl.
*G09F 15/00* (2006.01)

(52) U.S. Cl.
USPC ..... 40/607.09; 40/607.03; 248/218.4; 248/224.7

(58) Field of Classification Search
USPC ..... 40/607.07, 607.13, 612, 607.09
See application file for complete search history.

(56) References Cited

U.S. PATENT DOCUMENTS

| | | | | |
|---|---|---|---|---|
| 3,958,351 | A * | 5/1976 | Summey | 40/607.12 |
| D285,220 | S * | 8/1986 | Cooper et al. | D20/42 |
| 5,230,176 | A * | 7/1993 | Schomaker | 40/607.11 |
| 2007/0193088 | A1 * | 8/2007 | Lemberger et al. | 40/544 |

* cited by examiner

*Primary Examiner* — Casandra Davis

(57) ABSTRACT

A sign assembly includes a mount adapted to be fastened to a vertically oriented surface and a horizontal support having one end affixed to the mount and extending therefrom in cantilevered fashion. A first vertical rod is affixed to and extends vertically upward from the horizontal support, and a second vertical rod is affixed to and extends vertically upward from the horizontal support and laterally disposed from the first vertical rod. A placard having at least one surface adapted for the display of an advertising message thereon is affixed to the first and the second vertical rods.

5 Claims, 5 Drawing Sheets

SIGN DISPLAY

CROSS-REFERENCE TO RELATED APPLICATION

This Non-Provisional Utility application claims the benefit of U.S. Provisional Patent Application Ser. No. 61/533,870, filed on Sep. 13, 2011, which is incorporated herein in its entirety.

FIELD OF THE INVENTION

The present disclosure generally relates to an apparatus for supporting a sign, and more particularly to a sign assembly for mounting to a vertical post.

BACKGROUND OF THE INVENTION

Signs take on many representations and uses. Some are permanent, and others are temporary. Usually the goal of a sign is to elicit a response from a viewer or to simply inform a viewer of the sign with the message printed thereon. Commercial signage is a form of advertising which attempts to inform a passer-by of a business or product that may be of interest. In these cases, the sign functions as a notice or invitation by a seller that the seller has merchandise for sale and for a potential purchaser to view the merchandise. The sign can be remote from the business or be positioned at the seller's place of business. In some cases, when the object to be sold is inconvenient or unable to be relocated to the site of the business, the signage is positioned at the site where the object to be sold is located. One such case of placing outdoor signage at the location of the object is for advertising parcels of commercial or residential real estate that are for sale.

Real estate agents in particular rely heavily on outdoor advertising to promote the sale of commercial and residential properties. One outdoor advertising display commonly used in the real estate industry is adapted to display a corrugated cardboard sign and includes a metal support structure shaped as an uppercase letter "H." The lower legs of the H-shaped display are pushed into the ground on or near the property being advertised and the upper legs of the H-shaped display are used to support the corrugated sign. Another outdoor advertising display commonly used in the real estate industry is a vertically disposed wooden post. The lower portion of the vertically disposed wooden post is buried in the ground at a depth sufficient to support the post in an upright position. A shorter wooden beam extends horizontally from an upper end of the vertically disposed post, and a sign is coupled to, and hangs from, the horizontally disposed beam.

However, there are significant disadvantages to each of these mounts for signage. Some properties do not have exposed ground into which the sign support can be inserted. Also, the ground may be frozen in northern climates during the winter thereby preventing placing the supporting post or frame into the ground. The large supporting post requires a hole of substantial depth to support the remainder of the post, beam and sign. Further, the H-shaped display is close to the ground, as opposed to being at eye level, and as such is more difficult to see. Therefore, a temporary sign support is needed that is easily affixed to and removable from the property at a visible height, but yet will withstand placement for extended periods of time.

SUMMARY OF THE INVENTION

The present disclosure is generally directed to a sign assembly and sign support structure that satisfies the need for a sign that can be easily affixed to and removed from a vertical surface. The sign assembly includes a mount adapted to be fastened to a vertically oriented surface and a horizontal support having one end affixed to the mount and extending therefrom in cantilevered fashion. A first vertical rod is affixed to and extends vertically upward from the horizontal support, and a second vertical rod is affixed to and extends vertically upward from the horizontal support and laterally disposed from the first vertical rod. A placard having at least one surface adapted for the display of an advertising message thereon is affixed to the first and the second vertical rods.

In another aspect, the mount comprises a flat plate and defines a plurality of holes therethrough for receiving fasteners to attach the mount to the vertically oriented surface.

In still another aspect, the horizontal support is affixed to the mount by a weldment.

In yet another aspect, the mount defines a female threaded aperture therethrough and the horizontal support includes, at the one end, male threads formed thereon, the male threads engaged in the female threaded aperture.

In a still further aspect, the first and the second vertical rods are affixed to the horizontal support by weldment.

In another aspect, the horizontal support defines laterally separated female threaded apertures therethrough and each vertical rod includes one end having male threads formed thereon, and the male threads of the vertical rods are engaged in the female threaded apertures of the horizontal support.

In another aspect, the mount, the horizontal support, and the first and the second vertical rods are of a single uniform structure of molded resin.

In a still further aspect, the horizontal support, and the first and the second vertical rods are formed of a pair of twisted wire rods.

In yet another aspect, the placard defines two parallel channels, one channel receiving therein the first vertical rod and a second channel receiving the second vertical rod.

In another aspect, the placard is affixed to the first and the second vertical rods with tie straps.

In still another aspect, a sign support structure for displaying a placard having an advertising message thereon includes a mount adapted to be fastened to a vertically oriented surface and a horizontal support having one end affixed to the mount extending therefrom in cantilevered fashion. A first vertical rod is affixed to and extends vertically upward from the horizontal support; and a second vertical rod is affixed to and extends vertically upward from the horizontal support. The second vertical rod is laterally disposed from the first vertical rod.

In yet another aspect, the mount comprises a flat plate and defines a plurality of holes therethrough for receiving fasteners to attach the mount to the vertically oriented surface.

In another aspect, the horizontal support is affixed to the mount by weldment.

In still another aspect, the mount defines a female threaded aperture therethrough and the horizontal support includes, at the one end, male threads formed thereon, the male threads engaged in the female threaded aperture.

In yet another aspect, the first and the second vertical rods are affixed to the horizontal support by weldment.

In a still further aspect, the horizontal support defines laterally separated female threaded apertures therethrough and each vertical rod includes one end having male threads formed thereon. The male threads of the vertical rods are engaged in the female threaded apertures of the horizontal support.

In another aspect, the mount, the horizontal support, and the first and the second vertical rods are of a single uniform structure of molded resin.

In another aspect, the mount, the horizontal support, and the first and the second vertical rods are formed of a pair of twisted wire rods.

In a still further aspect, a sign support structure for displaying a placard having an advertising message thereon includes first and second wire rods twisted one with the other along a partial length of the wire rods. At least a portion of the twisted wire rods form a horizontal support segment and an end portion of the twisted wire rods form a vertical mount segment. A first loop for receiving a mounting fastener therethrough is formed of an end of the first wire rod forming a portion of the vertical mount segment, and a second loop for receiving a mounting fastener therethrough is formed of an end of the second wire rod forming a portion of the vertical mount segment. A first vertical rod is formed of an untwisted end of the first wire rod distal from the vertical mount portion, and a second vertical rod is formed of an untwisted end of the second wire rod distal from the vertical mount portion. The second vertical rod is substantially parallel to and laterally displaced from the first vertical rod.

In yet another aspect, the loop ends of the first wire rod and the second wire rod diverge one from the other to form the mount portion as a Y-shaped mount portion.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
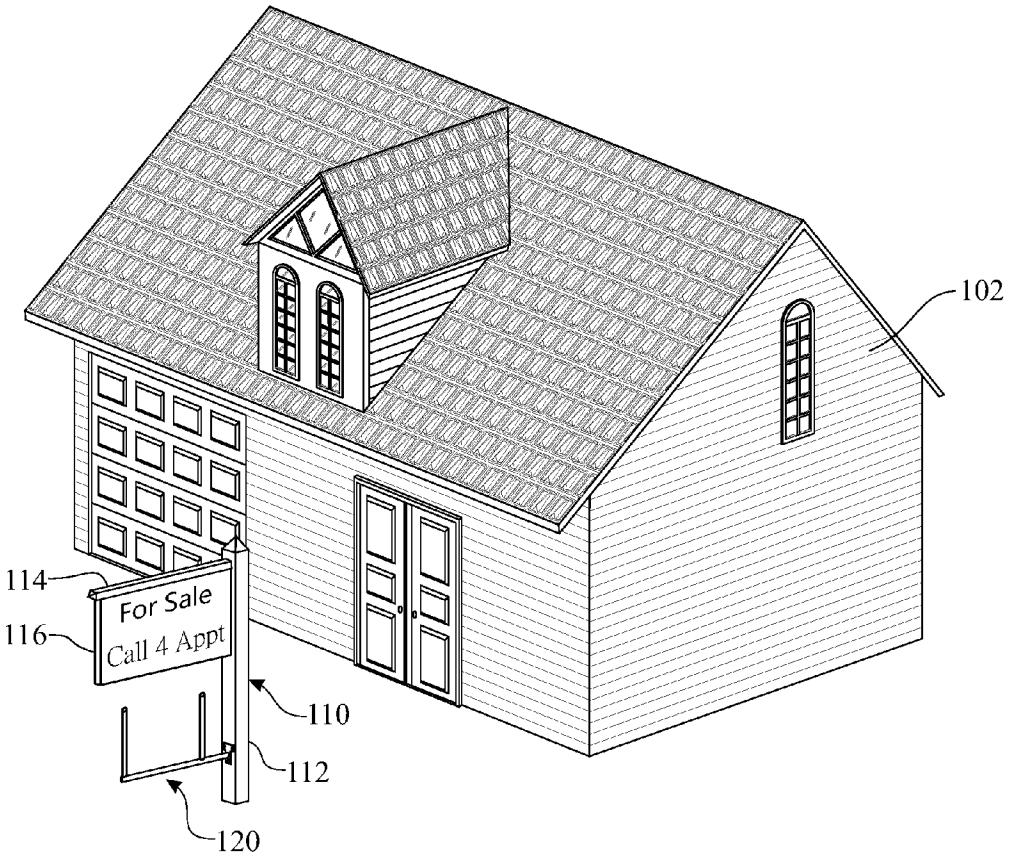
FIG. 1 presents a perspective view of a sign assembly embodying the present invention, wherein the sign assembly is affixed to a vertical post.

In one exemplary implementation of the invention as illustrated in FIG. 1, a realtor's listing sign 110 is placed in the front yard of a house 102 that is for sale. The listing sign 110 in its known configuration includes a vertical post 112 with a horizontal beam 114 affixed to an upper portion of the vertical post 112. A sign 116 indicating the property being for sale depends from the horizontal beam 114. The realtor's listing sign 110 also includes fastened to a lower portion thereof, a sign assembly 120 according to an exemplary implementation of the invention and illustrates its various components.

Figure 2:
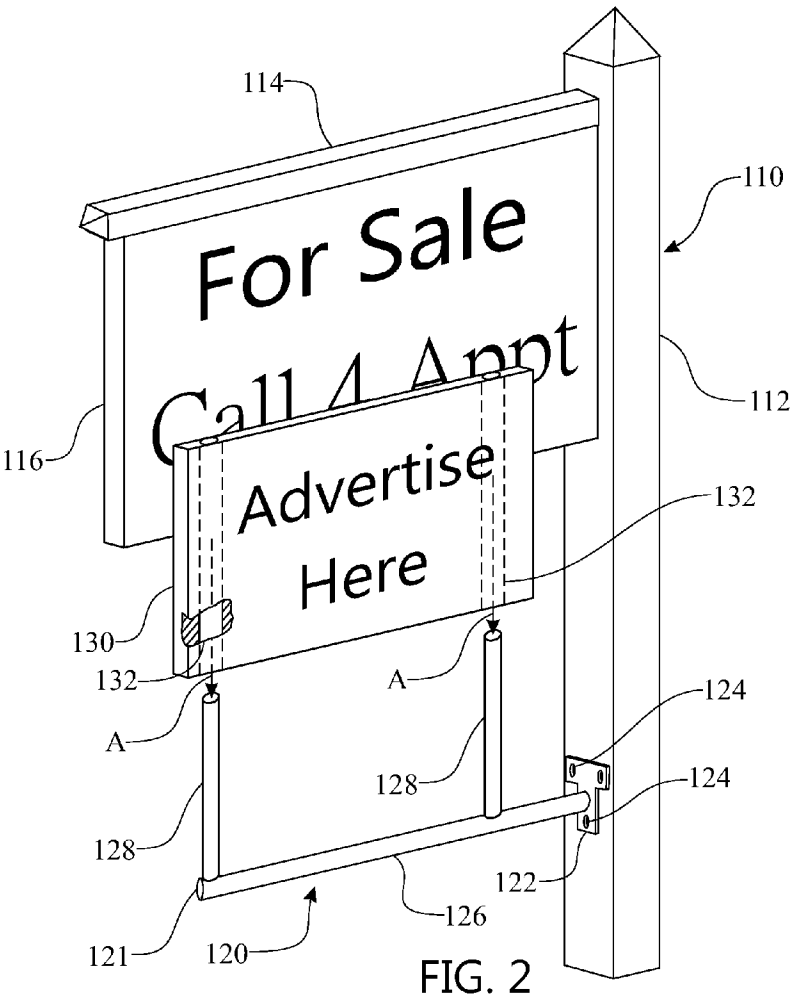
FIG. 2 presents a perspective elevation view of the signpost with the sign assembly affixed thereto.
Figure 3:
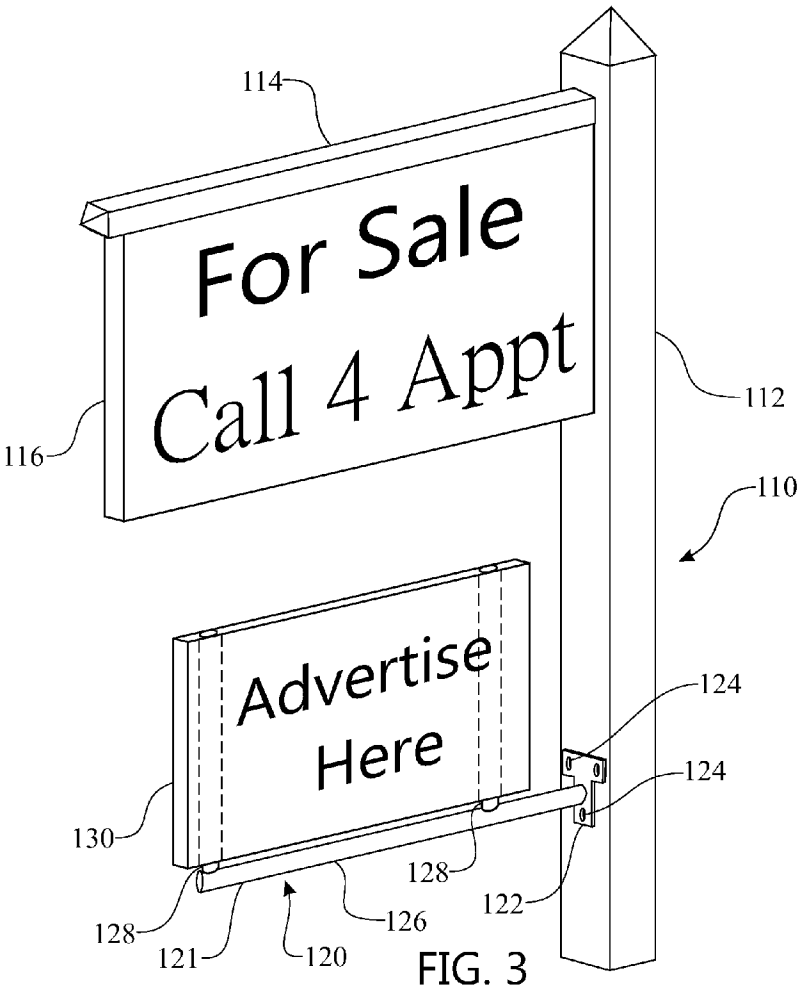
FIG. 3 presents a perspective elevation view of the signpost and sign assembly of FIG. 2 with a placard engaged on the sign support.

As best shown in FIGS. 2-3, the realtor's sign 110 includes a vertical post 112 which is embedded in the ground to maintain the signage in an upright supported generally vertical orientation. A horizontal beam 114 extends from a top of the vertical post 112 and has depending therefrom a sign 116 which can contain a notice that a house is for sale and a phone number to call to make an appointment to see the house. However, the listing realtor may desire to display additional information that may not fit on the sign 116. A sign assembly 120 according to an embodiment of the present invention may be added to a vertical surface of the vertical post 112. Those practiced in the art will recognize that while the sign assembly 120 is illustrated as being attached to the vertical post 112, the sign assembly 120 can also be affixed to any vertical surface that promotes visibility to a passer-by, such as a porch post on the house, the wall of a building, a tree in the front yard, etc. and is not limited to attachment to the vertical post 112 of the realtor's listing sign 110.

As shown, the sign display or sign assembly 120 includes a mount 122 that is vertically oriented to accommodate attachment to a vertical surface. Typically, the mount 122 is a flat metal plate and can be of any desired shape. Here, the mount 122 is formed in the shape of a "T" wherein the mount 122 defines two holes 124 at the top of mount 122 and a single hole 124 at the bottom. Fasteners (not shown) are received through the holes 124 and are engaged in the vertical post 112 to secure the mount 122 to the vertical post 112. The configuration of the fasteners used to secure the mount 122 are dependent on the material of the surface to which the mount 122 is affixed, and are generally well known in the industry.

A horizontal support 126 extends horizontally from the mount 122 in a cantilevered fashion and is affixed to the mount 122 by weldment or alternatively, an end of the horizontal support 126 can have male threads formed thereon which are received in a female threaded aperture in the mount 122 in a well known manner. Vertical rods 128 are welded to the horizontal support 126 and are substantially parallel one with respect to the other and further are laterally spaced one from the other along the length of the horizontal support 126 to extend upwardly from the horizontal support 126. Alternatively, the vertical rods 128 can also have male threads formed on a bottom end which, in turn, are received in female threaded apertures in the horizontal support 126.

The mount 122, the horizontal support 126, and the two vertical rods 128 in combination form a support structure 121 on which a placard 130 is supported. The support structure 121 can also be formed of a unitary molded resin in the described form of the support structure 121. The placard 130 is typically formed of a corrugated cardboard and has at least one surface for displaying an advertising message thereon. The placard 130 can also define, through an interior thereof, a pair of channels 132 (inherent in the corrugations of the cardboard) into which are received the vertical rods 128 to secure the placard on the support structure 121 of the sign assembly 120. The placard 130 can also be comprised of any known signage material such as a plastic or metal sheet. Alternatively, in lieu of vertical rods 128 being received in channels 132, the placard 130 can be secured to vertical rods 128 utilizing tie straps, nails, or screws (not shown) in a manner known in the industry.

Figure 4:
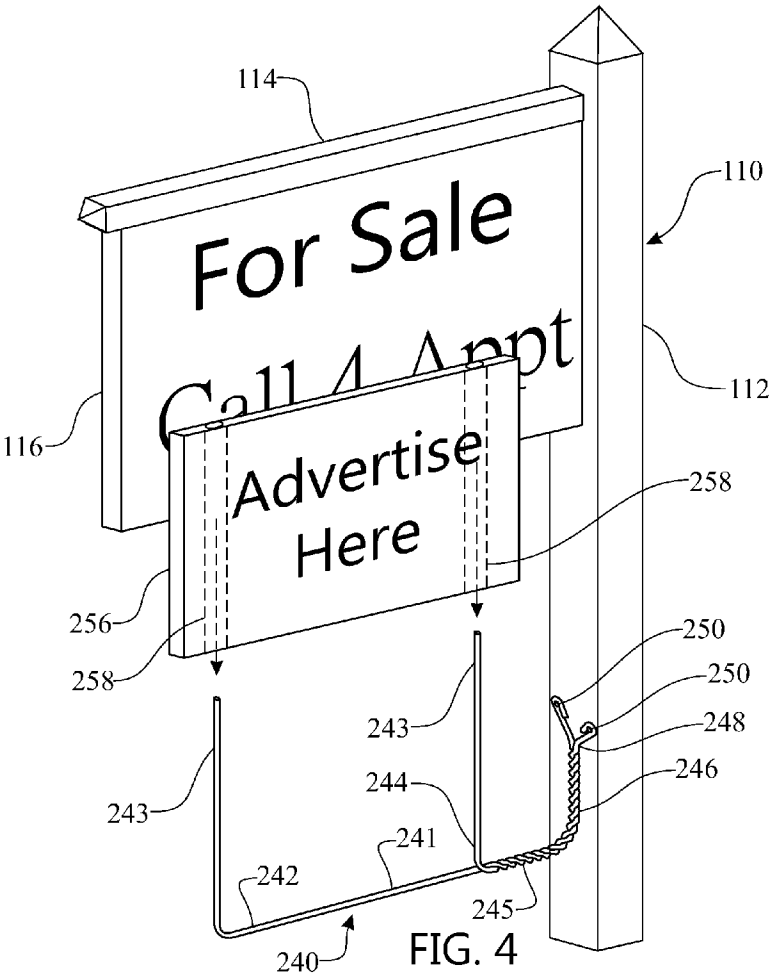
FIG. 4 presents a perspective elevation view of a signpost with an alternate embodiment sign assembly affixed thereto.
Figure 5:
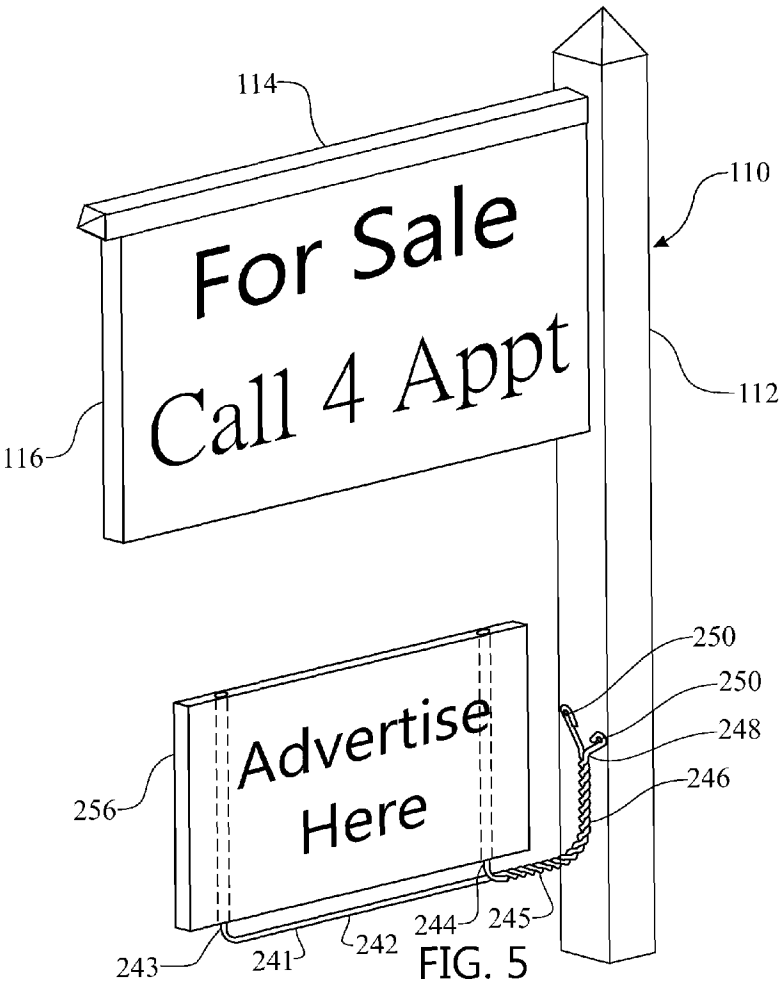
FIG. 5 presents a perspective elevation view of the signpost and sign assembly of FIG. 4 with a placard engaged on the sign support.

Referring now to FIGS. 4-5 an alternate embodiment sign assembly 240 is illustrated wherein a support structure 241 is formed of two wire rods 242, 244 that are twisted together one with the other over a portion of their respective lengths. A horizontal support segment 245 is formed of the twisted portion and an end portion of the twisted wire rods form a vertical mount segment 246 by substantially bending the vertical mount segment 246 at a right angle with respect to the horizontal segment 245. The ends of the first wire rod 242 and second wire rod 244 proximate to the vertical mount segment 246 are formed into loops 250 for receiving fasteners (not shown) therethrough to mount the sign assembly to a vertical surface. The looped ends of first wire rod 242 and second wire rod 244 can be bent such that the looped ends diverge one from the other to form a Y-shaped mount portion 248.

An untwisted portion of the first wire rod 242 extends horizontally from horizontal support segment 245 and at an end distal from the vertical mount segment 246 is bent vertically upward to form a vertical rod 243. In like manner, an untwisted portion of the second wire rod 244 at an end distal from the vertical mount segment 246 is bent vertically upward to also form a vertical rod 243. The vertical rods 243 are substantially parallel one with respect to the other and are laterally disposed one from the other to support a placard 256 thereon. The placard 256 is typically formed of a corrugated cardboard and has at least one surface for displaying an advertising message thereon. The placard 256 can also define through an interior thereof, a pair of channels 258 (inherent in the corrugations of the cardboard) into which are received the vertical rods 243 to secure the placard on the support structure 241 of sign assembly 240. The placard 256 can also be comprised of any known signage material such as a plastic or metal sheet. Alternatively, in lieu of the vertical rods 243 being received in channels 258, the placard 256 can be secured to vertical rods 243 utilizing tie straps, nails, or screws (not shown) in a manner well known in the industry.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A sign assembly comprising:

a mount adapted to be fastened to a vertically oriented surface;

a horizontal support having one end affixed to said mount and extending therefrom in cantilevered fashion;

a first vertical rod affixed to and extending vertically upward from said horizontal support;

a second vertical rod affixed to and extending vertically upward from said horizontal support and laterally disposed from said first vertical rod;

a placard having at least one surface adapted for a display of an advertising message thereon, said placard affixed to said first and said second vertical rods; and wherein said mount, said horizontal support, and said first and said second vertical rods are formed of a pair of twisted wire rods.

2. A sign assembly comprising:

a mount adapted to be fastened to a vertically oriented surface;

a horizontal support having one end affixed to said mount and extending therefrom in cantilevered fashion;

a first vertical rod affixed to and extending vertically upward from said horizontal support;

a second vertical rod affixed to and extending vertically upward from said horizontal support and laterally disposed from said first vertical rod; and a placard having at least one surface adapted for a display of an advertising message thereon, said placard affixed to said first and said second vertical rods; and wherein said placard defines two parallel channels, one said channel receiving therein said first vertical rod and a second said channel receiving said second vertical rod.

3. A sign support structure for displaying a placard having an advertising message thereon, said sign support structure comprising:

a mount adapted to be fastened to a vertically oriented surface;

a horizontal support having one end affixed to said mount and extending therefrom in cantilevered fashion;

a first vertical rod affixed to and extending vertically upward from said horizontal support;

a second vertical rod affixed to and extending vertically upward from said horizontal support and laterally disposed from said first vertical rod; and wherein said mount, said horizontal support, and said first and said second vertical rods are formed of a pair of twisted wire rods.

4. A sign support structure for displaying a placard having an advertising message thereon, said sign support structure comprising:

first and second wire rods twisted one with the other along a partial length of said wire rods, at least a portion of said twisted wire rods forming a horizontal support segment and an end portion of said twisted wire rods forming a vertical mount segment;

a first loop formed of an end of said first wire rod forming a portion of said vertical mount segment for receiving a mounting fastener therethrough;

a second loop formed of an end of said second wire rod forming a portion of said vertical mount segment for receiving a mounting fastener therethrough;

a first vertical rod formed of an untwisted end of said first wire rod distal from said vertical mount segment; and a second vertical rod formed of an untwisted end of said second wire rod distal from said vertical mount portion, said second vertical rod substantially parallel to and laterally displaced from said first vertical rod.

5. A sign support structure according to claim 4 wherein said loop ends of said first wire rod and said second wire rod diverge one from the other to form said mount portion as a Y-shaped mount portion.

* * * * *